United States Patent [19]

Gall

[11] 4,078,483

[45] Mar. 14, 1978

[54] CONTAINER CONTROLLED MARKING ASSEMBLY FOR CONVEYORS

[75] Inventor: Richard C. Gall, Milwaukee, Wis.

[73] Assignee: Jos. Schlitz Brewing Company, Milwaukee, Wis.

[21] Appl. No.: 677,370

[22] Filed: Apr. 15, 1976

[51] Int. Cl.[2] ..... B41F 17/16

[52] U.S. Cl. ..... 101/44; 101/363; 101/379

[58] Field of Search ..... 101/44, 35, 41, 364, 101/363, 330, DIG. 3, 379

[56] References Cited

U.S. PATENT DOCUMENTS

| | | | |
|---|---|---|---|
| 914,234 | 3/1909 | Brown | 101/41 |
| 1,364,815 | 1/1921 | Santee et al. | 101/35 |
| 1,420,187 | 6/1922 | Douglas | 101/44 |
| 1,803,323 | 5/1931 | Evans | 101/35 |
| 2,184,510 | 12/1939 | Adams | 101/379 |
| 2,195,173 | 3/1940 | Jackson | 101/35 |
| 2,284,628 | 6/1942 | Almgren | 101/44 |
| 2,635,531 | 4/1953 | Bruce et al. | 101/35 |
| 2,909,991 | 10/1959 | Farkas | 101/35 |
| 2,935,015 | 5/1960 | Wilson et al. | 101/44 |
| 3,599,566 | 8/1971 | Fish | 101/364 X |

FOREIGN PATENT DOCUMENTS

| | | | |
|---|---|---|---|
| 238,673 | 11/1960 | Australia | 101/44 |

*Primary Examiner*—Clifford D. Crowder
*Attorney, Agent, or Firm*—Andrus, Sceales, Starke & Sawall

[57] ABSTRACT

A pivotally mounted starwheel is selectively positioned to sequentially engage a series of containers such as beer cans freely mounted on a moving conveyor bed. The starwheel rotates in response to a predetermined number of containers operatively applying pressure thereto and rotates an inter-connected supporting wheel providing a series of radially and circumferentially spaced printing units which sequentially engage an inking wheel and the containers for applying a mark thereto. The inking wheel is coupled through a transmission and drive wheel to the supporting wheel and rotates in synchronism with the starwheel. The ink source includes plural ink retainers inter-connected by a gravity feed and cooperates with a pair of ink transfer wheels. Each of the printing units is cam operated and includes a pair of oppositely biased pistons which compensate for variances in container height.

2 Claims, 8 Drawing Figures

Fig.1
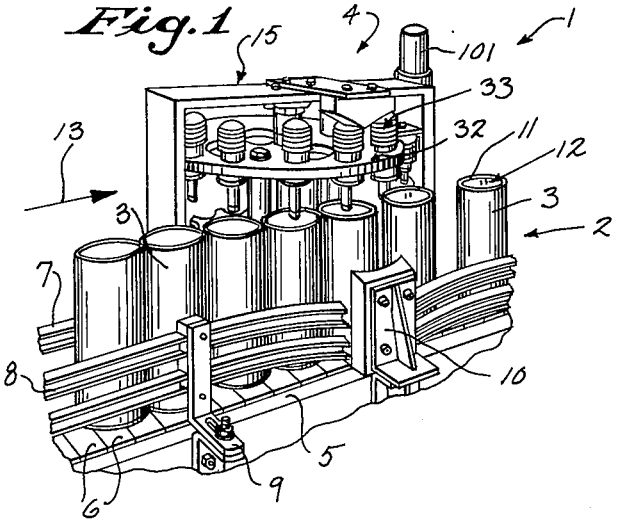
Fig.3
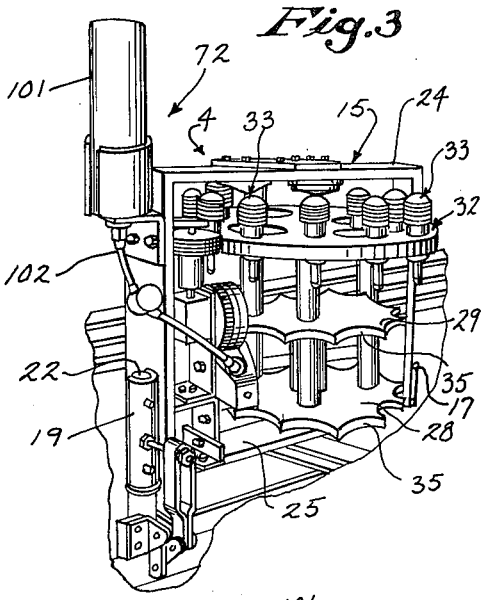
Fig.2
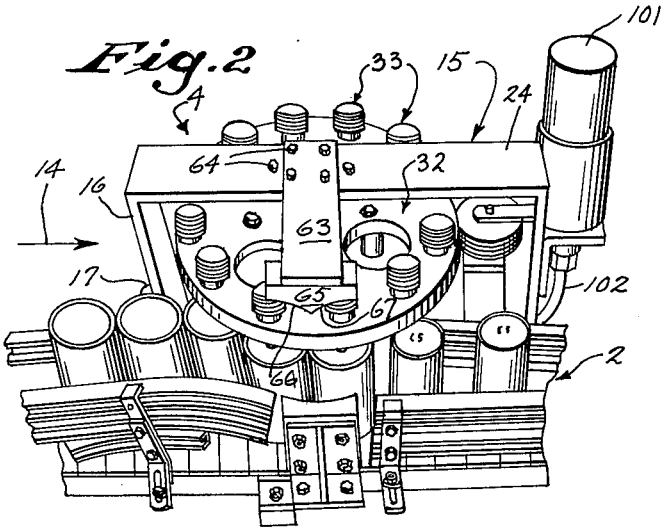
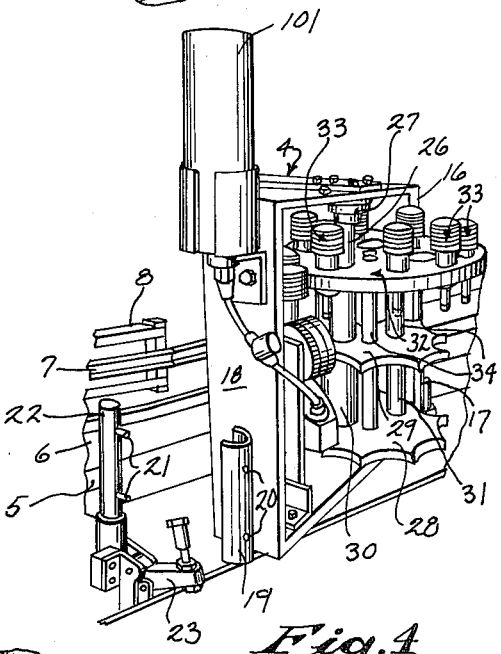
Fig.4
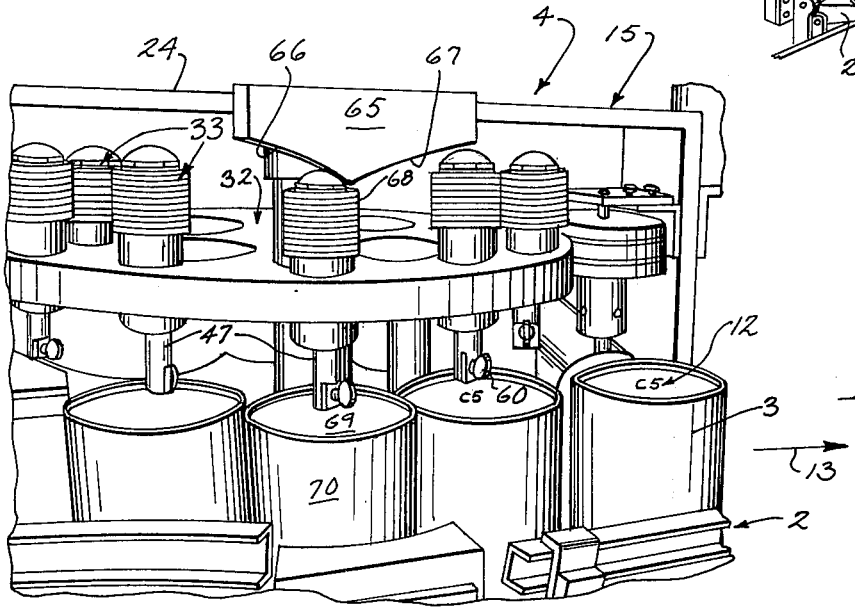
Fig.5

CONTAINER CONTROLLED MARKING ASSEMBLY FOR CONVEYORS

BACKGROUND OF THE INVENTION

This invention relates to an assembly for marking a series of containers traveling with a moving conveyor.

It is frequently desirable to mark individual containers traveling in a packaging line or the like with information concerning the contents therein, the location of the packaging plant, or the date when the containers have been filled. As an example, it may be desirable to apply a mark to containers such as beer cans indicating the date when the cans were sealed.

Many previous container marking or stamping assemblies have used electric motors for operating a starwheel or other container engaging mechanism for positively controlling the movement of the containers as they move through the marking or printing station, such as shown in U.S. Pat. No. 2,935,015 issued on May 3, 1960 to Wilson et al. and U.S. Pat. No. 2,879,711 issued on Mar. 31, 1959 to Hirschey et al.

Other can stamping systems employ conveyors utilizing drive cogs with each cog engaging an individual can or article for operating a starwheel at the printing station, such as shown in the U.S. Pat. No. 1,006,814 issued on Oct. 24, 1911 to White.

Some article stamping assemblies employ radiating arms each carrying an associated stamp biased downwardly by a single spring. Some assemblies utilize flat or circular inking pads functioning with stamp carriers and operated in synchronism with a moving starwheel engaging the articles to be stamped.

SUMMARY OF THE INVENTION

This invention relates to an assembly for marking a series of containers moving along a conveyor line.

In one form of the invention, a conveyor line provides a substantially flat moving bed which supports a series of containers movable therewith in response to friction between the containers and the moving bed. A printing station is spaced adjacent to the moving bed and includes a movable guide sequentially engaging the series of containers and also retaining a series of printing elements selectively engaging a substantially continuous marking fluid retaining surface operatively connected to the guide and marking the series of containers. The guide moves in response to a predetermined number of containers operatively applying pressure thereon for moving the marking fluid retaining surface and the printing elements in synchronism with the moving containers so that the printing elements selectively engage the marking fluid retaining surface and the containers.

The invention provides a unique operation for high speed container operations wherein the printing station operates in response to line pressure provided by the series of containers engaging one another and operatively applying pressure to the movable guide. The invention is particularly desirable because an independent power source such as an electric motor is not required for operating the printing station. Furthermore, the invention eliminates the requirement for conveyor cogs or other container engaging apertures and permits the use of a substantially flat or smooth conveyor thereby permitting the cans to engage one another for creating the necessary line back pressure for operting the printing station.

The movable guide of the printing station is pivotally mounted and is movable between a first position wherein the containers are sequentially engaged and a second position wherein the guide is completely free of the containers. In such manner, the printing mechanism may be completely withdrawn from the conveyor line so that the containers may freely move without engaging the printing station mechanism.

In another aspect of the invention, the printing units are specially designed to compensate for large variances in container dimension which may be encountered in an abnormal situation or small variances frequently found in normal operations. In this regard, each printing unit includes a first piston movably retained by the supporting structure and biased in a first direction while a second piston is movably retained by the first piston and biased in a second direction opposite to the first direction. The second piston retains a printing element while the supporting structure provides a cam which selectively engages the first piston to move the printing element in the second direction into engagement with the container. The second piston moves in the first direction in response to the engagement of the printing element with the container thereby providing a compensating response for variances in container dimension.

The variable response provided by each of the printing units prevents damage to the printing station and to the containers should any of the containers be deformed to be larger than expected and further permits the printing unit to engage and mark containers which are deformed and smaller than might be customary for the conveyor line.

In a preferred form of the invention, each printing unit includes a base which is fixedly connected to the supporting structure while the first piston is movably connected to the base by a first spring. The second piston is movably connected to the first piston by a second spring. Each of the printing heads is enclosed to protect the biasing springs and provide reliable compensation for substantially long periods of use.

In another aspect of the invention, the printing station provides supporting means which sequentially engages the series of containers and also retains a series of printing elements selectively engaging a marking fluid applicator and marking the containers. In a unique sequence, the applicator provides a marking fluid retaining surface which rotates in response to a predetermined number of containers operatively applying pressure to the supporting means.

The rotation of the marking fluid retaining surface in response to container back pressure and movement permits extended usage of the applicator mechanism. Such construction is far superior to stationary pads which may become badly worn after cyclic use.

In another aspect of the marking fluid applicator mechanism, a radially spaced second marking fluid retaining surface engages a marking fluid source and a substantially radially spaced first marking fluid retaining surface and functions to transfer marking fluid from the source to the first surface. In such manner, a uniform coating of marking fluid is constantly maintained for application to the printing elements.

In a preferred construction, a first radially spaced circumferential marking fluid retaining surface forms a portion of a first marking fluid wheel while a second radially spaced circumferential marking fluid retaining surface forms a portion of a second marking fluid wheel.

The first wheel is coupled through a transmission to a friction wheel which engages the moving support so that the first wheel rotates in synchronism with the series of moving containers. The second wheel rotates in response to the rotation of the first wheel and transfers marking fluid from a source to the first wheel. The source is specially designed to provide a first fluid retaining enclosure providing a wick in contact with marking fluid therein which also engages the second marking fluid retaining surface. A second fluid retaining enclosure is spaced above the first enclosure and supplies marking fluid by gravity through a conduit to the first enclosure. With such construction, marking fluid is continually supplied from the second enclosure to the first enclosure of the source while marking fluid is continually transmitted through the wick to the second inking wheel. Movement of the supporting means in response to container pressure operatively rotates the first wheel through the friction wheel and transmission mechanism.

In a preferred construction, the movable supporting means includes a starwheel engaging the series of containers moving on the conveyor while a supporting wheel is connected to the starwheel by a common axial shaft. The series of printing units are circumferentially spaced at radially spaced locations so that rotation of the supporting wheel selectively positions each printing unit at a location for operation by the cam to selectively engaging a corresponding container. The supporting wheel also provides a radially spaced circumferential surface which engages the friction wheel for providing a coupling to drive and operate the marking fluid applicator.

The invention thus provides a desirable and unique construction for efficient operation with a high speed conveyor system.

BRIEF DESCRIPTION OF THE DRAWINGS

The drawings furnished herewith illustrate the best mode presently contemplated by the inventor and clearly disclose the above advantages and features as well as others which will be readily understood from the detailed description thereof.

In the drawings:

FIG. 1 is a perspective view of a marking assembly showing a printing station selectively marking cans moving on a conveyor line;

FIG. 2 is an elevated prospective view of the printing station of FIG. 1;

FIG. 3 is a perspective view of the back side of the printing station of FIGS. 1 and 2 positioned next to a conveyor line for engaging cans thereon;

FIG. 4 is a perspective view of the printing station and conveyor line of FIG. 3 showing the printing station pivoted to a retracted position dis-engaged from the conveyor line;

FIG. 5 is a perspective view showing the operation of a cam with a series of printing units engaging the cans in the conveyor line of FIGS. 1 and 2;

DESCRIPTION OF THE PREFERRED ILLUSTRATED EMBODIMENT

Figure 6:
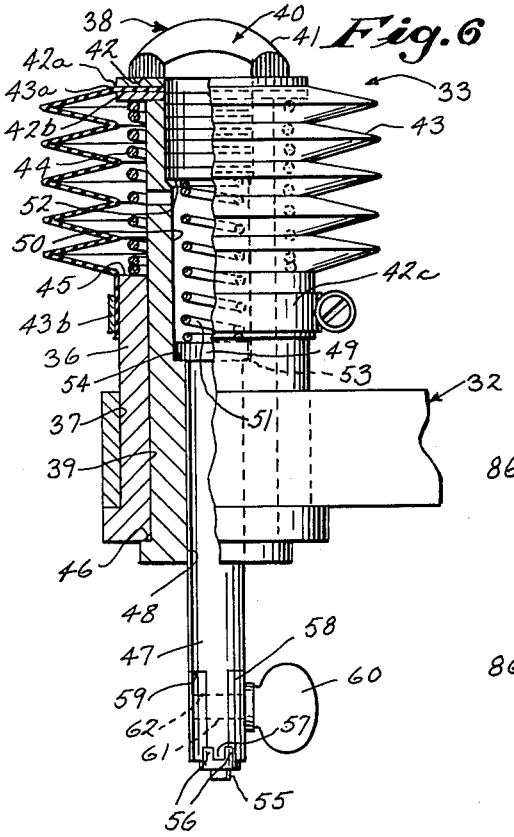
FIG. 6 is a side elevational view of a printing unit employed in FIGS. 1–5 with portions broken away.
Figure 7:
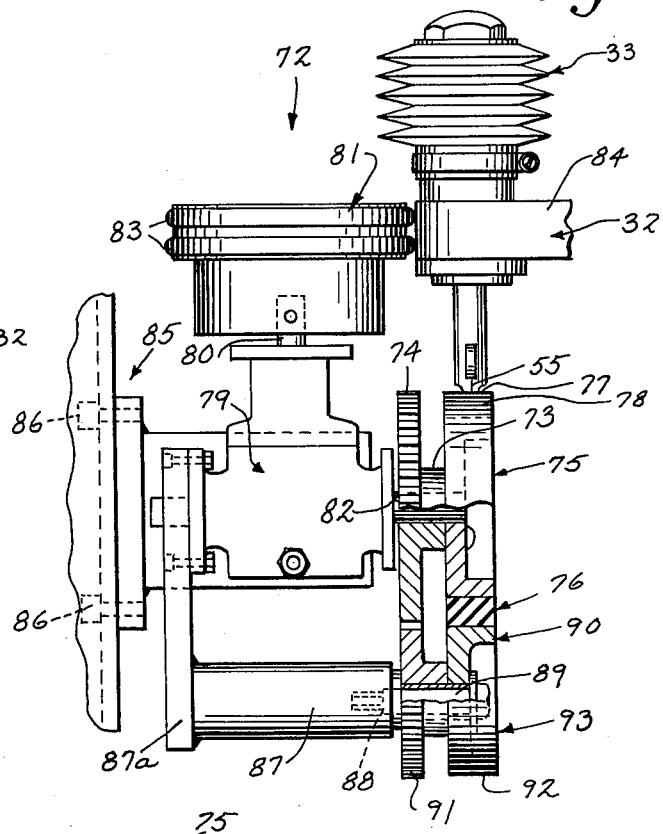
FIG. 7 is a side elevational view of a portion of the printing station employed in FIGS. 1–5 showing portions of the inking transfer mechanism.
Figure 8:
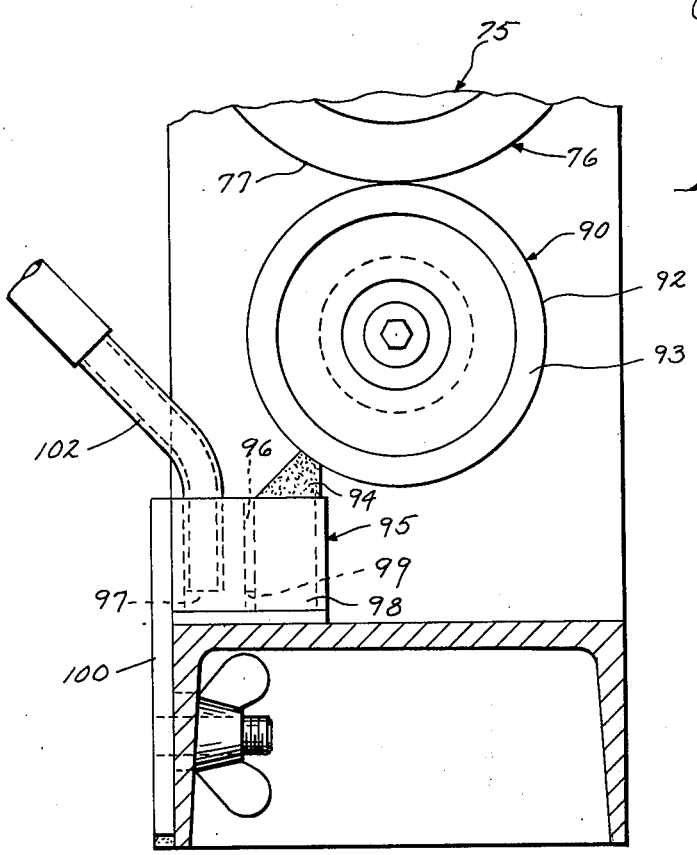
FIG. 8 is a side elevational view showing a portion of the printing station employed in FIGS. 1–5 showing portions of the inking transfer mechanism.

Referring to the drawings and particularly FIGS. 1–5, a marking assembly 1 includes a conveyor 2 moving a series of containers 3 such as beer cans or the like through a printing station generally shown at 4.

The conveyor 2 includes a supporting structure 5 upon which a series of inter-connected slats 6 form a conveyor bed for supporting and moving the series of containers 3. Side rails 7 and 8 are spaced at opposite sides of the slats 6 and are fixedly connected to the supporting structure 5 by bracket supports 9. An additional guide 10 is fixedly connected to the support structure 5 and is positioned adjacent to the printing station 4. Each beer can 3 is formed in a customary shape having a cylindrically shaped side wall and a pair of spaced end closures as at 11, with one end closure 11 being stamped at the printing station 4 to provide an indicia or marking 12 indicating the date when each can 3 was sealed. The cans 3 are freely mounted upon the conveyor 2 and slidably engage the series of substantially flat slats 6, the latter being driven by a motor (not shown) at predetermined speeds. With such construction, the cans 3 are carried by the moving conveyor 2 solely through gravity and are premitted to slip or slide with respect to the slats 6 whenever the cans 3 engage an obstruction. The conveyor 2 in FIGS. 1 and 2 moves the series of cans 3 in the direction of arrow 13.

A rectangularly shaped support 15 provides a side wall 16 pivotally connected to the supporting structure 5 by a hinge connector 17. The oppositely spaced wide wall 18 of the rectangular support 15 provides a releasable bracket connector 19 having a series of openings 20 which cooperate with a series of projections 21 provided by a post 22, the latter fixedly connected to the supporting structure 5. A toggle type clamping assembly 23 removably engages the connector 19 and firmly retains the rectangular support 15 adjacent to the post 22.

With the toggle mechanism 23 firmly pressing bracket 19 into firm engagement with post 22, the printing station 4 is located immediately adjacent to the conveyor 2 and is in condition as illustrated in FIG. 3 for marking or stamping indicia upon the series of cans 3. With the toggle mechanism 23 released, the rectangular support 4 may be selectively rotated to a second position as illustrated in FIG. 4 so that the printing station 4 is moved away from the conveyor line 2 for permitting the free passage of cans 3 without engagement by the printing station mechanism 4.

The top and bottom walls 24 and 25, respectively, of the rectangular support 15 are inter-connected by an axle 26 rotatably secured through appropriate bearing assemblies as at 27. A starwheel 28 is fixedly connected to a lower portion of axle 26 while a starwheel 29 is fixedly connected to an intermediate portion of axle 26 and spaced from starwheel 28 by a separating sleeve 30. A series of circumferentially spaced separators 31 are radially spaced from the axle 26 and provide further separation and support between the starwheels 28 and 29.

A supporting wheel 32 is fixedly connected to an upper portion of the axle 26 and includes a series of circumferentially spaced printing units 33 radially spaced from the axle 26. A series of circumferentially spaced separators 34 are radially spaced from the axle 26 and inter-connect the intermediate starwheel 29 with the supporting wheel 32 to provide separation therebetween and provide added stability to the structure. The starwheels 28 and 29 together with the supporting wheel 32 thus form a unitary structure fixedly connected to the axle 26 and mounted for rotation through the bearing assemblies 27 with respect to the rectangular support 15.

The starwheels 28 and 29 each includes a series of circumferentially spaced pockets or recesses 35 designed to engage the outer circumferential surface of the beer cans 3. It is noted that the recesses 35 for starwheels 28 and 29 are axially aligned with each other so that aligned pockets of the starwheels simultaneously engage a single beer can as it passes through the printing station 4.

One of the printing units 33 is shown in greater detail in FIG. 6 and includes an annular shaped base member 36 retained within an opening 37 provided by the supporting wheel 32 and fixedly inter-connected thereto by a press fit or the like. A piston 38 is movably located within an opening 39 provided by the annular base member 36. The piston 38 provides a head 40 providing a camming surface 41 and a radially extending annular lip 42 engaging a washer **42*a*. An annular shaped bellows 43 made of soft rubber or the like provides a first axial end 43*a* which is securely sandwiched between the washer 42*a* and a second washer 42*b* and a second axial end 43*b* fixedly secured to the base member 36 by an annular clamp 42*c*. The annular rubber bellows 43 contains the customary folds or axially expanding or contracting in response to the movement of the piston 38. A biasing spring 44 is connected to a radial end 45 of the annular support 36 and operatively applies biasing force to the annular lip 42 through the washers 42*a* and 42*b* and the axial end 43*a* of the bellows 43. The camming surface 41 is thus biased in a direction away from the fixed support 36 and is restricted by a radially extending annular lip 46 provided at an axial end of piston 38**.

A second piston 47 is located within a cylindrical opening 48 provided by piston 38 and provides a radially extending flange 49 at an axial end thereof slidably mounted within an enlarged portion 50 of the cylindrical opening 48. The flange 49 of piston 47 is biased in a direction away from the camming surface 41 by a helical spring 51 engaging a circular wall portion 52 within the cylindrical cavity 50 and the flange 49. Movement of piston 47 away from the camming surface 41 is restricted by a radially extending annular surface 53 provided by the flange 49 abutting against an annular portion 54 provided by the piston 38.

A printing element 55 provides a pair of spaced teeth 56 which removably engage a projection 57 provided by the piston 47. A pair of spaced wedging members 58 are located within oppositely spaced grooves 59 provided by piston 47 and are secured thereto by a thumb screw 60 having a threaded shaft 61 engaging internal threads provided in an opening 62 within one of the clamping elements 58.

The printing element 55 may thus be readily inserted or removed by the simple release of the thumb screw 60. With element 55 inserted to engage the projection 57, the members 58 are drawn together by rotation of the thumb screw 60 to tightly clamp the printing element 55 to the piston 47.

The upper wall 24 of the rectangular support 15 provides a laterally extending extension 63 secured by bolts 64 or the like. A cam 65 is fixedly connected to a laterally extending end of extension 63 and provides a pair of camming surface 66 and 67.

The rotation of the supporting wheel 32 in response to rotation of the starwheels 28 and 29 provides rotative movement to the series of printing units 33. A printing unit such as specifically illustrated by unit 68 in FIG. 5 rotates and engages the cam surface 66 of cam 65. In such manner, the camming surface 41 engages surface 66 and forces piston 38 to move towards an end cover 69 of a can 70 by compressing the spring 44. As the printing element 55 engages the end cover 69, the compensating spring 51 is compressed to permit movement of piston 47 toward the head 40 of piston 38. In such manner, the printing unit 68 automatically compensates for any possible deviations in can height. For example, such automatic compensation is particularly desirable for use with containers such as beer cans having ends to be stamped which are normally either concave or convex. Should any one of the cans provide a bulging end so as to add an additional one-half inch in container heighth, for example, or be otherwise deformed, the printing unit will continue functioning in a normal manner without experiencing damage.

An ink applicator 72 includes a central hub 73 providing a driving gear 74 located at a first axial end and transfer wheel 75 including inking applicator 76 located at a second axial end. The inking applicator 76 includes a radially spaced circumferential surface 77 provided by an annular ink retaining rubber applicator 78. The first axial end of hub 73 containing gear 74 is coupled to a transmission unit 79 which may include a plurality of gears coupling an input shaft 80 fixedly connected to a friction wheel 81 with an output shaft 82 connected to gear 74 and shaft 73. A pair of radially spaced circumferential bands 83 formed from rubber or the like are coupled about the wheel 81 and engage a radially spaced circumferential surface 84 provided by the supporting wheel 32.

The transmission 79 is connected to the wall 18 through a support 85 by a series of bolts 86 or the like. A secondary support **87*a* is connected through bolts or the like to the transmission 79 and provides an outwardly extending bearing support 87 retaining a unibearing assembly 88 rotatably mounting an output shaft 89. A ink pick-up wheel 90 and an adjacently spaced gear 91 are fixedly connected to a rotatable axle 89 with external gear teeth provided by gear 91 engaging external gear teeth provided by gear 74**.

The ink pick-up wheel 90 includes a radially spaced circumferential surface 92 formed from nylon or other suitable material 93. The surface 92 is engaged by an ink transfer wick 94 which projects outwardly from an ink retaining closure 95. The closure 95 inclues a wall separator 96 defining a pair of ink retaining chambers 97 and 98, the latter retaining the wick 94. An opening 99 is located at the bottom of the separating wall 96 and permits ink to freely flow between chambers 97 and 98. The ink retaining closure 95 is secured to a bracket assembly 100 which, in turn, is coupled to the rectangular support 15.

A secondary ink supply source 101 is mounted to the side wall 18 and supplies ink through a tube 102 to the chamber 97 provided by the ink closure 95.

The system thus provides a desirable container marking operation in response to back pressure developed by the series of cans engaging one another upon entering the printing station. Upon initial activation of the printing station 4, the starwheels 28 and 29 will be engaged by the first or initial can proceeding along the conveyor line 2. The first or initial can engaging starwheels 28 and 29 will not exert sufficient force to rotate or operate the printing station 4. In such a situation, the first or initial can will completely stop and slip or slide upon the conveyor 2 which continues to move at predetermined speeds. The second or subsequent can will engage the first can and also come to a complete stop. Two stopped cans will not operate the printing mechanism because they do not provide sufficient back pressure or force necessary to rotate the starwheels 28 and 29. Subsequently arriving cans will likewise exert operative pressure tending to rotate the starwheels 28 and 29 and operate the printing unit 4. When a predetermined number of inter-connecting cans accumulate at the printing station, sufficient back pressure will be exerted upon the starwheels 28 and 29 causing their rotation. As an example, a back pressure provided by twelve cans each of three inches in diameter being supplied on a conveyor operating at approximately one hundred feet per minute will rotate the starwheels 28 and 29 thereby operating the printing mechanism. The pressure requirement can be readily adjusted by varying the conveyor speed and friction between axle 26 and support 15.

As starwheels 28 and 29 rotate, support 32 will likewise rotate so that one of the printing units 33 will rotate to a printing position for engagement with the cam 65 as illustrated by unit 68 in FIG. 5. In such manner, the printing unit 68 moves into a printing position in synchronism with the movement of a corresponding can as at 69 in FIG. 5 so that the printing element 55 will be thrust by cam 65 against the container end member 69 and provide an indicia 12 thereon.

With printing unit 68 rotating to engage cam 65 and provide a printing or marking sequence, another printing unit 33 circumferentially spaced from unit 68 is simultaneously rotated to engage the ink transfer surface 77 of transfer wheel 75. In such manner, the printing element 55 receives a fresh supply of ink from the transfer wheel 75 before proceeding to a marking or stamping application sequence.

The selective positioning of each printing unit 33 into position for receiving ink from the transfer wheel 75 correspondingly rotates the transfer wheel 75. Specifically, the friction wheel 81 rotates in synchronism with the support wheel 32 and thus in synchronism with the can movement through the starwheels 28 and 29. The ink transfer wheel 75 and the ink pick-up wheel 90 thus rotate in synchronism with the friction wheel 81 as provided by transmission 79 and gears 74 and 91. A continuous supply of ink is thus conducted by gravity from the secondary ink source at 101 through tube 102 to the primary ink supply in closure 95. The wick 94 continuously conducts ink by capilliary action from the closure 95 to the outer surface 92 of the secondary ink pick-up wheel 90 which operates in synchronism with the starwheels 28 and 29 to transfer ink to the transfer wheel 75.

With such synchronism in operation, ink is continually supplied to the plurality of marking elements 55 prior to their engagement in a marking sequence. The utilization of a pair of ink transfer wheels with a continuous ink supply provides a durable inking system for reliable long lasting inking applications.

The invention thus provides a highly desirable container marking apparatus which may be selectively positioned adjacent to a high speed conveyor system while in full operation to provide a marking sequence in response to the back pressure provided by a series of cans moving on the conveyor line.

Various modes of carrying out the invention are contemplated as being within the scope of the following claims particularly pointing out and distinctly claiming the subject matter which is regarded as the invention.

I claim:

1. An assembly for marking a series of up-standing containers, comprising a substantially flat moving conveyor bed supporting said series of up-standing containers movable therewith in response to friction between said containers and said moving bed, and a printing station spaced adjacent to said moving bed and including a rotating starwheel operatively connected to a rotating support retaining a series of printing units selectively engaging said series of containers while movably retained on said moving conveyor bed and a marking fluid applicator, each of said printing units including a base fixedly connected to said supporting means and a first piston movably connected to said base by a first spring and a second piston movably connected to said first piston by a second spring and retaining a printing element, said supporting means including a cam selectively engaging said first piston and moving said printing element in a first direction into engagement with said container while movably retained on said moving conveyor bed and said second piston moving in a second direction opposite to said first direction in response to the engagement of said printing element with said container, said applicator including a first wheel having a first radially spaced circumferential marking fluid retaining surface selectively engaging by said printing elements, a transmission connected to rotate said first wheel and having a friction wheel engaging said moving supporting means and rotating said first wheel in synchronism with said series of moving containers, a second wheel having a second radially spaced circumferential marking fluid retaining surface engaging said first surface and rotating in response to the rotation of said first wheel, and a marking fluid source including a first marking fluid retaining enclosure providing a wick in contact with marking fluid therein engaging said second surface and a second marking fluid retaining enclosure spaced above said first enclosure and supplying marking fluid by gravity through a conduit to said first enclosure, said starwheel sequentially engaging said series of containers on said moving bed and rotating in response to a predetermined number of containers operatively applying pressure to said starwheel and rotating said first wheel and said printing elements to selectively engage said elements with said first wheel and said containers.

2. The assembly of claim 1, wherein said rotating support includes a supporting wheel connected to said starwheel by a common axial shaft with said printing units circumferentially spaced at radially spaced locations and said supporting wheel providing a radially spaced circumferential surface, said friction wheel engaging said circumferential surface of said supporting wheel and rotating said first wheel in synchronism with said series of moving containers.

* * * * *

UNITED STATES PATENT AND TRADEMARK OFFICE

CERTIFICATE OF CORRECTION

PATENT NO. : 4,078,483

DATED : March 14, 1978

INVENTOR(S) : RICHARD C. GALL

It is certified that error appears in the above-identified patent and that said Letters Patent are hereby corrected as shown below:

Column 1, Line 67 Cancel "operting" and substitute therefor ---operating---, Column 4, Line 26, Cancel "premitted" and substitute therefor ---permitted---, Column 4, Line 32, Cancel "wide" and substitute therefor ---side---, Column 6, Line 2, Cancel "surface" and substitute therefor ---surfaces--- Column 6, Line 53, Cancel "inclues" and substitute therefor ---includes---, Column 8, Line 36, CLAIM 1, Cancel "engaging" and substitute therefor ---engaged---

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*